US011350754B2

(12) United States Patent
Bergsma

(10) Patent No.: US 11,350,754 B2
(45) Date of Patent: Jun. 7, 2022

(54) MODULAR FURNITURE WITH REPLACEABLE PANELS

(71) Applicant: MiEN Company, Grand Rapids, MI (US)

(72) Inventor: Remco Bergsma, Grand Rapids, MI (US)

( * ) Notice: Subject to any disclaimer, the term of this patent is extended or adjusted under 35 U.S.C. 154(b) by 0 days.

(21) Appl. No.: 17/000,975

(22) Filed: Aug. 24, 2020

(65) Prior Publication Data

US 2021/0068548 A1 Mar. 11, 2021

Related U.S. Application Data

(60) Provisional application No. 62/936,795, filed on Nov. 18, 2019, provisional application No. 62/899,037, filed on Sep. 11, 2019.

(51) Int. Cl.

| | |
|---|---|
| ***A47C 4/02*** | (2006.01) |
| ***A47C 7/62*** | (2006.01) |
| ***A47C 13/00*** | (2006.01) |
| ***A47C 12/02*** | (2006.01) |
| ***A47C 3/16*** | (2006.01) |
| ***A47C 7/24*** | (2006.01) |

(Continued)

(52) U.S. Cl.

CPC ..... *A47C 4/028* (2013.01); *A47C 3/16* (2013.01); *A47C 7/024* (2013.01); *A47C 7/0213* (2018.08); *A47C 7/18* (2013.01); *A47C 7/24* (2013.01); *A47C 12/02* (2013.01)

(58) Field of Classification Search

CPC ..... A47C 4/028; A47C 7/0213; A47C 3/16; A47C 7/024; A47C 7/18; A47C 4/02; A47C 13/005

USPC ..... 297/188.08, 188.09, 188.1, 188.12, 297/188.13, 440.1, 440.14, 423.39, 297/423.41; 182/33, 35, 129

See application file for complete search history.

(56) References Cited

U.S. PATENT DOCUMENTS 395,539 A * 1/1889 Bockenheuser ..... A47C 12/02 297/2 X
799,418 A * 9/1905 Thompson ..... E03D 5/10 4/300

(Continued)

FOREIGN PATENT DOCUMENTS

DE 3135869 A1 * 3/1983 ..... A47C 1/028
EP 2145567 B1 2/2011
FR 2293168 A1 * 7/1976 ..... A47C 15/002

OTHER PUBLICATIONS

Companion Cube—5 Hidden Seats Ottoman; Expand Furniture; accessed on the Internet at https://expandfurniture.com/product/companion-cube-5-hidden-seats-ottoman/ on Jul. 1, 2019.

*Primary Examiner* — Rodney B White
(74) *Attorney, Agent, or Firm* — Oppenhuizen Law PLC; David L. Oppenhuizen

(57) ABSTRACT

An article of furniture including a base, a plurality of panels forming an outer surface of the article of furniture, and a plurality of struts for securing the panels in place. The base has an outer periphery which is securable to at least some of the panels. The base is configured for placement on a floor surface. Further, each strut has an elongated member configured for securement to at least two adjacent panels which are oriented in different planes from one another. The adjacent panels are secured to the respective struts with removable fasteners.

9 Claims, 9 Drawing Sheets

(51) Int. Cl.
*A47C 7/02* (2006.01)
*A47C 7/18* (2006.01)

(56) References Cited

U.S. PATENT DOCUMENTS 1,293,967 A * 2/1919 Stalder ..... E06C 9/10 182/35 X
1,639,085 A * 8/1927 Fohey ..... A47C 11/00 297/188.13 X
2,164,715 A * 7/1939 Krainbill ..... A47C 13/005 297/440.14 X
2,532,863 A * 12/1950 Taylor ..... B65D 9/14 297/188.08 X
2,597,860 A * 5/1952 Gerber ..... A47C 4/028 297/440.23 X
2,658,640 A * 11/1953 Bayles ..... E06C 1/005 297/188.1 X
2,749,968 A * 6/1956 Suser ..... A47K 13/00 4/661
3,030,146 A * 4/1962 Faxon ..... A47C 4/02 297/440.1 X
3,035,671 A * 5/1962 Sicherman ..... E06C 1/005 52/183
3,104,913 A * 9/1963 Faulkner ..... A47C 4/02 297/440.1 X
3,139,307 A * 6/1964 Hawley ..... A47C 4/028 297/452.65
3,171,690 A * 3/1965 Weiss ..... A47C 4/02 297/440.23
3,329,465 A * 7/1967 King ..... A47C 7/42 297/440.21
3,380,777 A 4/1968 Bennett
3,563,599 A 2/1971 Heumann
3,578,110 A * 5/1971 Seagraves ..... E04F 11/02 182/129
3,578,385 A * 5/1971 Stiglitz ..... A47C 15/002 297/440.23
3,632,150 A * 1/1972 Milakovich ..... A47C 4/02 297/440.15 X
3,658,382 A * 4/1972 Anderson ..... A47C 4/02 297/440.15 X
3,716,872 A * 2/1973 Zieman ..... A47K 13/00 297/188.1
3,774,966 A * 11/1973 Faulkner ..... A47C 4/02 297/440.23
4,043,591 A * 8/1977 Lehmann ..... A47C 13/005 297/440.14 X
4,067,073 A * 1/1978 Komarov ..... A47C 4/028 297/440.1 X
4,139,077 A * 2/1979 Pena, Jr. ..... A47B 83/00 182/35 X
4,165,902 A * 8/1979 Ehrlich ..... A47C 4/02 297/440.11
4,234,976 A * 11/1980 Litkewycz ..... A47C 4/02 297/440.1
4,305,616 A * 12/1981 Martinez ..... A47C 4/028 297/440.1 X
4,523,787 A 6/1985 Robinson
4,588,227 A * 5/1986 Austin ..... A47C 4/022 297/440.24
4,717,202 A * 1/1988 Batchelder, III ..... A47C 11/00 297/188.09 X
4,836,369 A * 6/1989 Pickering ..... B65F 1/08 297/188.13 X
4,932,720 A * 6/1990 Sherman ..... A47C 4/02 297/440.16 X
5,000,512 A * 3/1991 Laird ..... A47C 4/02 297/440.1 X
5,080,438 A * 1/1992 Moyer ..... A47C 4/028 297/440.23
5,107,957 A * 4/1992 Bennett ..... B65F 1/1426 182/129
5,277,476 A * 1/1994 Caldwell ..... A47C 4/028 297/440.1 X
5,452,554 A * 9/1995 Santana ..... A47B 47/0091 52/582.2
5,458,395 A * 10/1995 Skarda, Jr. ..... A47C 7/622 297/188.1
5,518,298 A * 5/1996 LaPointe ..... A47C 13/005 297/440.1
5,551,757 A * 9/1996 Glover ..... A47C 4/02 297/440.15 X
5,601,340 A * 2/1997 Stout ..... A47C 4/02 297/440.1
5,653,507 A * 8/1997 Moore ..... A47C 1/124 297/188.08
5,678,706 A * 10/1997 Husak ..... A47B 47/005 211/189
5,678,897 A * 10/1997 Prestia ..... A47C 4/02 297/440.15
5,713,650 A * 2/1998 King ..... A47B 81/00 312/265.4
5,727,849 A * 3/1998 Nelson ..... A47C 4/02 297/440.16
5,738,414 A * 4/1998 Wieland ..... A47C 4/02 297/440.1 X
5,795,028 A * 8/1998 Dussia, Jr. ..... A47C 13/005 297/440.14 X
5,878,470 A 3/1999 Blansett
5,890,767 A * 4/1999 Chang ..... A47C 4/02 297/440.14
6,367,880 B1 * 4/2002 Niederman ..... A47C 4/02 297/440.14
6,773,063 B2 * 8/2004 Eerkens ..... A47C 13/005 297/440.14 X
7,014,267 B1 * 3/2006 Nagar ..... A47B 47/0008 297/440.14
7,073,756 B1 * 7/2006 Walton ..... A47C 11/00 248/188.1
7,237,845 B2 * 7/2007 Mulmed ..... A47C 7/24 297/440.1 X
7,988,236 B2 * 8/2011 Brandtner ..... A47C 4/028 297/440.1
8,393,684 B2 * 3/2013 Peraza ..... E06C 1/387 182/33 X
8,438,716 B2 * 5/2013 Brandtner ..... F16B 12/14 29/525.01
8,453,795 B2 * 6/2013 Lee ..... A47C 12/00 182/33
8,950,817 B2 * 2/2015 Iacovoni ..... A47B 13/021 297/232 X
9,668,581 B1 * 6/2017 Hill ..... A47C 4/02
9,936,808 B2 4/2018 Iacovoni et al.
10,251,485 B2 * 4/2019 Sewell ..... A47C 4/028
10,980,348 B2 * 4/2021 Policicchio ..... A47C 17/02
2002/0017814 A1 * 2/2002 Niederman ..... A47C 4/02 297/440.16
2003/0107247 A1 * 6/2003 Wills ..... A47C 11/00 297/188.1 X
2005/0067876 A1 * 3/2005 Dortch ..... A47C 3/00 297/440.1
2006/0103220 A1 * 5/2006 Wade ..... A47C 4/028 297/440.14
2007/0132301 A1 * 6/2007 Yu ..... A47C 3/00 297/440.23
2008/0157571 A1 * 7/2008 Richardson ..... A47C 4/028 297/188.1
2009/0235451 A1 * 9/2009 Gorkin ..... A47C 4/022 297/440.14 X
2011/0101763 A1 * 5/2011 Chen ..... A47C 17/02 297/440.15
2012/0212021 A1 * 8/2012 Hunter ..... A47C 4/028 297/232
2015/0313363 A1 * 11/2015 Xie ..... A47C 5/04 297/258.1
2017/0347799 A1 * 12/2017 Sewell ..... A47B 95/00

(56) References Cited

U.S. PATENT DOCUMENTS

| | | | | |
|---|---|---|---|---|
| 2020/0260879 | A1* | 8/2020 | Nelson | A47C 7/028 |
| 2021/0196049 | A1* | 7/2021 | McCreary | A47C 17/04 |

* cited by examiner

MODULAR FURNITURE WITH REPLACEABLE PANELS

CROSS REFERENCE TO RELATED APPLICATION

This application claims the benefit of U.S. Provisional Application 62/899,037, which was filed on Sep. 11, 2019, and U.S. Provisional Application 62/936,795, which was filed on Nov. 18, 2019, the disclosures of which are hereby incorporated by reference.

BACKGROUND OF THE INVENTION

1. Field of the Invention

The present disclosure pertains to an article of furniture. More particularly, the present invention pertains to an article of furniture formed by assembling a plurality of removable or replaceable panels and is suitable for providing a cubical seating arrangement.

2. Description of the Prior Art

Articles of furniture, such as cubical seats, are typically utilized in schools for providing a seating arrangement to school children. These articles of furniture are frequently damaged or rapidly soiled due to a lack of care and extensive use. Furthermore, such articles of furniture are typically constructed as fixed units, and therefore require either replacement or substantial repair costs when damage occurs to only a portion of the article of furniture.

SUMMARY OF THE INVENTION

According to an aspect of the disclosure an article of furniture is disclosed. The article of furniture includes a base, a plurality of panels forming an outer surface of the article of furniture, and a plurality of struts for securing the panels in place. The base has an outer periphery which is securable to at least some of the panels. The base is configured for placement on a floor surface. Each strut has an elongated member configured for securement to at least two adjacent panels which are oriented nonplanar with one another. The adjacent panels are secured to the respective struts with removable fasteners.

Optionally, at least two adjacent panels are oriented substantially perpendicular to one another.

Optionally, the panels define an interior of the article of furniture, and the base includes an opening for accessing the interior of the article of furniture.

Optionally, the base is rectangular in shape.

Optionally, the fasteners include a threaded bolt and threaded nut.

Optionally, the threaded nut is fixedly secured to the panel, the strut includes a hole, and the threaded bolt extends through the hole and is threadingly engaged with the threaded nut.

Optionally, the panels are covered with an upholstery, and the upholstery may optionally cushioning. When upholstery is provided, the fasteners are preferably disposed behind the upholstery.

Optionally, each of the panels are oriented along a substantially vertical plane or a substantially horizontal plane.

Optionally, a first one of the panels is oriented in a first substantially horizontal plane, and a second one of the panels is oriented in a second substantially horizontal plane, and the first substantially horizontal plane are distanced from the second substantially horizontal plane. Additionally, the first one of the panels and the second one of the panels are optionally covered with an upholstery and a cushioning.

Optionally, there is also provided a modular seating system including a plurality of adjacent articles of furniture in which each article of furniture includes a base, a plurality of panels forming an outer surface of the article of furniture, and a plurality of struts for securing the panels in place. The base has an outer periphery which is securable to at least some of the panels. The base is configured for placement on a floor surface. Each strut has an elongated member configured for securement to at least two adjacent panels which are oriented nonplanar with one another. The adjacent panels are secured to the respective struts with removable fasteners.

Optionally, the modular seating system includes at least two articles of furniture which are shaped differently from one another.

For a more complete understanding of the present invention, reference is made to the following detailed description and accompanying drawings. In the drawings, like reference characters refer to like parts throughout the views in which:

DETAILED DESCRIPTION OF A PREFERRED EMBODIMENT

Figure 1:
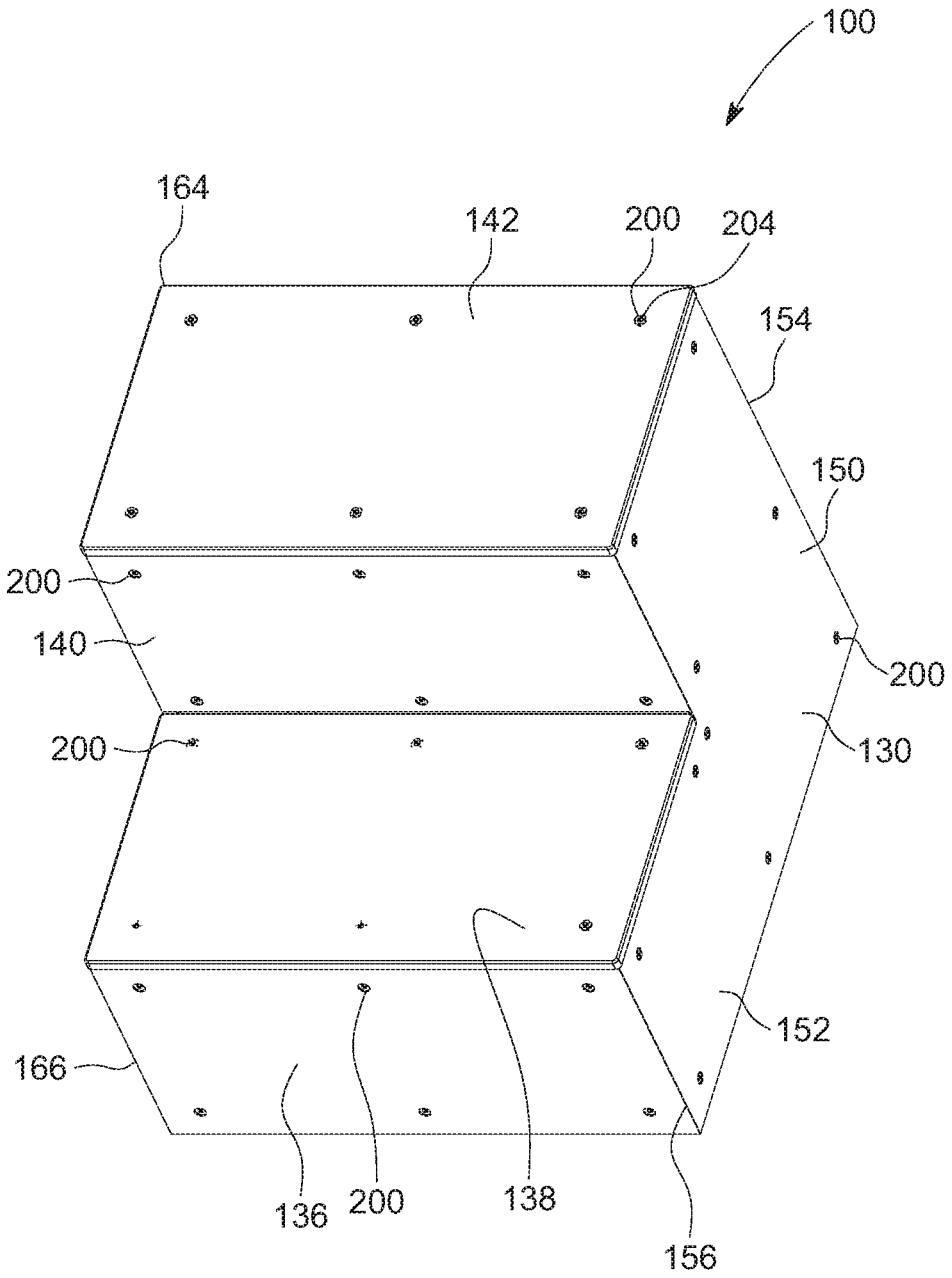
FIG. 1 illustrates a perspective view of an article of furniture, in accordance with an embodiment of the disclosure.
Figure 2:
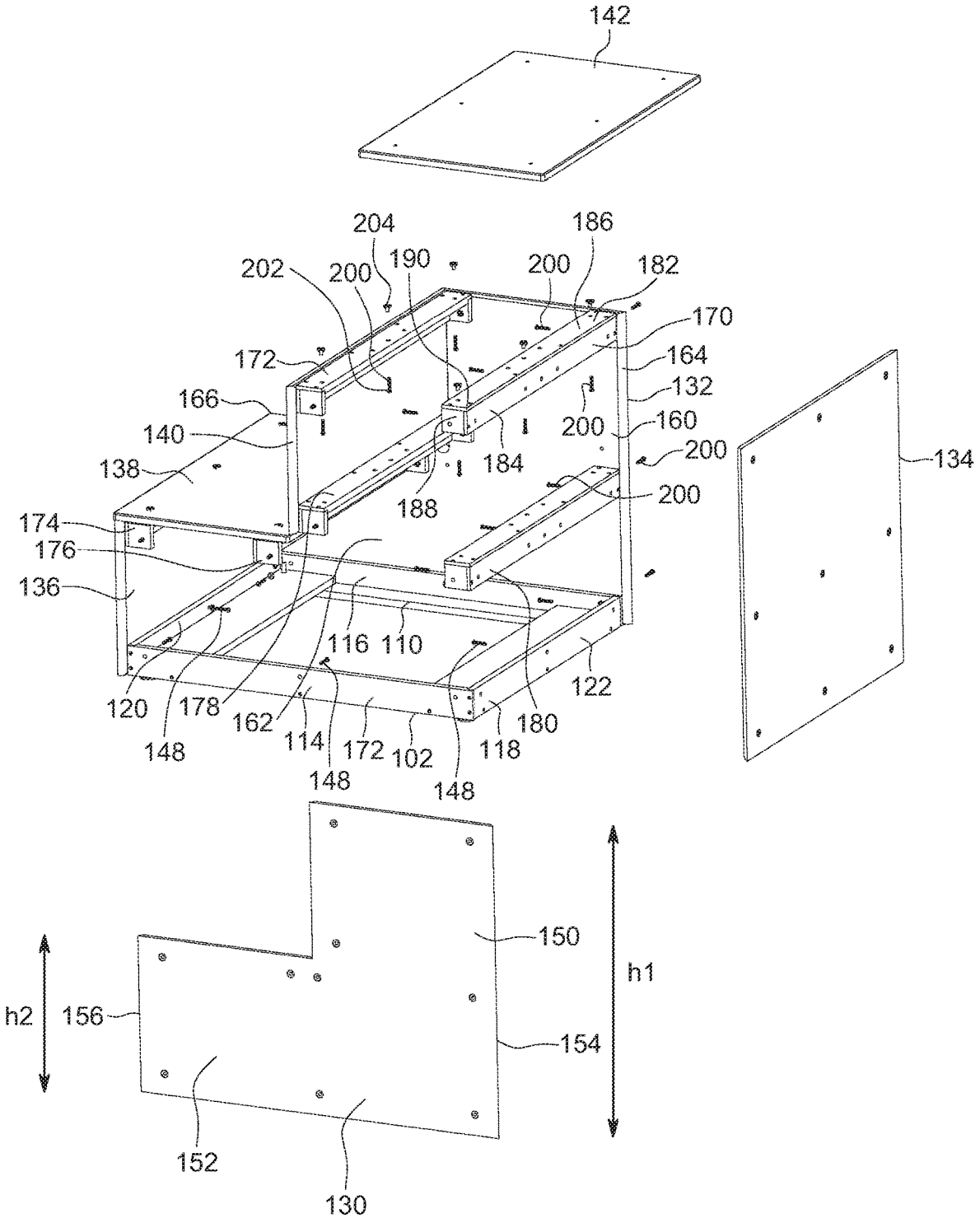
FIG. 2 illustrates a partially exploded view of the article of furniture of FIG. 1 depicting a plurality of struts used for attaching a plurality of panels, in accordance with an embodiment of the disclosure.

Referring to FIGS. 1 and 2, an exemplary article of furniture 100 suitable for providing a seat to one or more people is shown. The article of furniture 100 includes a base 102 adapted to be placed on a floor surface. The base 102 includes a bottom frame 110, and one or more walls (for example, a first wall 114, a second wall 116, a third wall 118, and a fourth wall 120) which extend substantially perpendicularly from the bottom frame 110. The bottom frame 110 and the walls define an outer periphery 122 of the base 102. The bottom frame 110 preferably has an opening or void that permits a user to access an interior of the article of furniture 100. Further, each wall 114, 116, 118, 120 may extend upwardly from the floor surface when the base 102 is placed on the floor surface. As shown, the bottom frame 110 may include a substantially rectangular structure, although the bottom frame 110 can be any suitable shape as desired, such as triangular, hexagonal, and so forth.

The article of furniture 100 further includes a plurality of panels, for example, a first panel 130, a second panel 132, a third panel 134, a fourth panel 136, a fifth panel 138, a sixth panel 140, and a seventh panel 142, defining a cuboidal structure of the article of furniture 100 having an interior. As shown, the first panel 130 and the second panel 132 act as the side panels of the article of furniture 100 and extend substantially perpendicular from the bottom frame 110 of the base 102. The first panel 130 and the second panel 132 are connected to the first wall 114 and the second wall 116 of the base 102, respectively. Preferably, the first panel 130 and the second panel 132 are removably coupled to the first wall 114 and the second wall 116 by using one or more fasteners 148, such as bolts. As shown, the first panel 130 and the second panel 132 each abuts the outer periphery 122 of the base 102.

The first panel 130 and the second panel 132 are disposed spaced apart and substantially parallel to each other, and the third panel 134 (also referred to as a rear panel) is nonplanar with (and preferably extends substantially perpendicularly to) the first panel 130 and the second panel 132. The third panel 134 is positioned between the first panel 130 and the second panel 132, and may be engaged with the first panel 130 and the second panel 132. The third panel 134 is nonplanar from (and preferably extends substantially perpendicularly from) the bottom frame 110 and may be connected to the third wall 118 of the base 102. As shown, the third panel 134 abuts the outer periphery 122 of the base 102 and extends upwardly from the base 102.

In an embodiment, the first panel 130 may include an "L" shape and may include a first portion 150 and a second portion 152. The first portion 150 may extend from a first lateral end 154 to the second portion 152, while the second portion 152 may extend from the first portion 150 to a second lateral end 156. As shown in FIG. 2, a height "h1" of the first portion 150 is greater than a height "h2" of the second portion 152. In this manner, the first portion 150 defines a vertical portion of the L-shape, while the second portion 152 defines a horizontal portion of the L-shape.

Similar to the first panel 130, the second panel 132 may include an "L" shape, and may include a third portion 160 and a fourth portion 162. The third portion 160 may extend from a first lateral end 164 to the fourth portion 162, while the fourth portion 162 may extend from the third portion 160 to a second lateral end 166. Further, a height of the third portion 160 is greater than a height of the fourth portion 162. In this manner, the third portion 160 defines a vertical portion of the L-shape, while the fourth portion 162 defines a horizontal portion of the L-shape. As illustrated, the third panel 134 extends from the first lateral end 154 of the first panel 130 to the first lateral end 164 of the second panel 132, while the fourth panel 136 extends from the second lateral end 156 of the first panel 130 to the second lateral end 166 of the second panel 132.

The fourth panel 136 (also referred to as a first front panel) may be disposed spaced apart from the third panel 134 and may be positioned substantially parallel to the third panel 134. Also, the fourth panel 134 is nonplanar with (and preferably extends substantially perpendicularly to) the first panel 130 and the second panel 132, and is disposed between the first panel 130 and the second panel 132. As illustrated, the fourth panel 136 is nonplanar from (and preferably extends substantially perpendicularly from) the bottom frame 110 and is removably coupled with the fourth wall 118 of the base 102. In an embodiment, the fourth panel 136 abuts the outer periphery 122 of the base 102, and is coupled to the fourth wall 118 by using the one or more fasteners 148, such as bolts. Also, a height of the fourth panel 136 is substantially equal to a height of the second portion 152 of the first panel 130 and a height of the fourth portion 162 of the second panel 132. The second portion 152 of the first panel 130, the fourth portion 162 of the second panel 132, and the fourth panel 136 may act as support panels to support the fifth panel 138.

The fifth panel 138 may be disposed substantially parallel to the bottom frame 110 and is adapted to provide a seating surface. The fifth panel 138 is connected to the second portion 152 of first panel 130, the fourth portion 162 of the second panel 132 and the fourth panel 138. Optionally, the fifth panel 138 may include upholstery to provide comfort to a person seating on the fifth panel 138.

Further, the sixth panel 140 is coupled to the fifth panel 138, and is nonplanar with (and preferably extends substantially perpendicularly to) the fifth panel 138 in a direction away from the bottom frame 110. The sixth panel 140 is connected to the first portion 150 of first panel 130 and the third portion 160 of the second panel 132, and is disposed nonplanar to (and preferably substantially perpendicular to) the first portion 150 and the third portion 160. Further, the sixth panel 140 is disposed spaced apart and substantially parallel to the third panel 134. The first portion 150, the third portion 160, the third panel 134, and the sixth panel 140 may act as a support for the seventh panel 142.

The seventh panel 142 is disposed substantially parallel to the bottom frame 110 and is adapted to provide a seating surface. The seventh panel 142 is connected to the first panel 130, the second panel 132, the third panel 134, and the sixth panel 140, such that the seventh panel 142 is nonplanar with (and preferably extends substantially perpendicularly to) each of the panels 130, 132, 134, 140. Optionally, the seventh panel 142 may include upholstery to provide comfort to a person seating on the seventh panel 142.

Referring to FIG. 2, the article of furniture 100 includes a plurality of struts, for example, a first strut 170, a second strut 172, a third strut 174, a fourth strut 176, a fifth strut 178, and a sixth strut 180, for removably connecting the plurality of panels to each other. Each strut of the plurality of struts connect at least two adjacent panels that are oriented in different planes. For example, the first strut 170 removably connects or secures the first panel 130, the third panel 134, the seventh panel 142, and the second panel 132 together, while the second strut 172 removably connects or secures the first panel 130, the sixth panel 140, the seventh panel 142, and the second panel 132 together. In this manner, the first strut 170 and the second strut 172 each secure three panels that are nonplanar and oriented in three different planes, and which are each preferably substantially perpendicular to each other. Further, the third strut 174 removably connects or secures the first panel 130, the fourth panel 136, the fifth panel 138, and the second panel 132 together, while the fourth strut 176 removably connects or secures the first panel 130, the fifth panel 138, and the second panel 132 together. In this manner, the third strut 174 secures three adjacent panels that are nonplanar and oriented in three different planes, while the fourth strut 176 connects or secures two adjacent panels that are oriented in two different planes and which are each preferably substantially perpendicular to each other. Additionally, or optionally, the fifth strut 178 removably connects or secures the first panel 130, the second panel 132, and the sixth panel 140, while the sixth strut 180 removably connects or secures the first panel 130, the second panel 132, and the third panel 134. A structure of the first strut 170 and a connection of the first strut 170 with various panels is explained hereinbelow.

Figure 3:
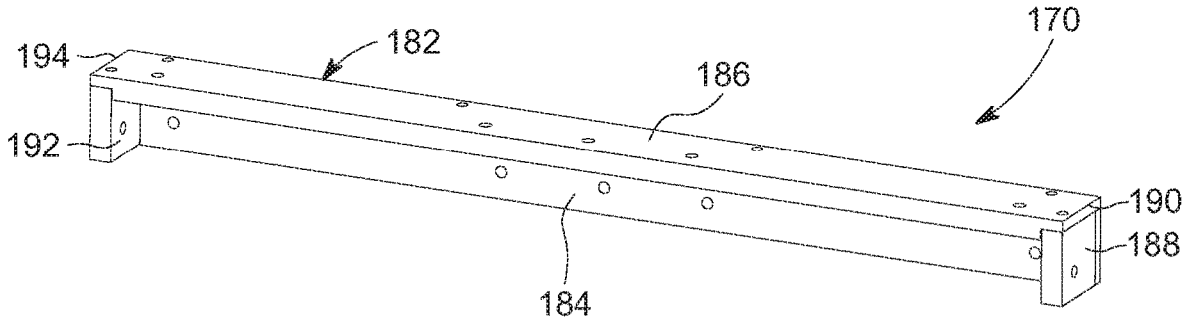
FIG. 3 illustrates a perspective view of a first strut of the article of furniture, in accordance with an embodiment of the disclosure.

Referring to FIGS. 2 and 3, the first strut 170 includes an elongated member 182 for securing the third panel 134 to the seventh panel 142. The elongated member 182 may be L-shaped in cross-section, and may include a first longitudinal member 184 (hereinafter referred to as first member 184) and a second longitudinal member 186 (hereinafter referred to as a second member 186) connected to the first member 184 and are nonplanar to (and preferably extending substantially perpendicularly to) the first member 184. As shown, the first member 184 extends along a width of the third panel 134, and is removably connected to the third panel 134 using fasteners 200, while the second member 186 extends along a width of the seventh panel 142, and is removable connected to the seventh panel 142 using the fasteners 200. In this manner, the elongated member 182 (i.e. the first strut 170) removably secures two adjacent panels 134, 142 that are nonplanar and being oriented in different planes.

Furthermore, the first strut 170 may include a third member 188 disposed at a first end 190 of the elongated member 182, and is connected perpendicularly to both the first member 184 and the second member 186. The third member 188 is removably connected to the first portion 150 of the first panel 130 using the fasteners 200. In this manner, the first strut 170 removably connects the three adjacent panels (the first panel 130, the third panel 134, and the seventh panel 142) that are disposed mutually perpendicular to each other and are oriented in three different planes. In an embodiment, the first strut 170 may include a fourth member 192 (shown in FIG. 3) disposed at a second end 194 of the elongated member 182, and connected perpendicularly to both the first member 184 and the second member 186. The fourth member 192 is removably connected or secured to the second panel 132 using the fasteners 200, and is disposed substantially parallel to the third member 188. The fasteners 200 may include threaded bolts 202 and threaded nuts 204, such as T-nuts. For the sake of clarity and brevity, only the structure of the first strut 170 and its connection with various panels is explained, and it is to be understood that the structure of each of the other struts 172, 174, 176, 178, 180 and their corresponding connection with various panels is similar to the structure and connections of the first strut 170.

As the article of furniture 100 includes removable panels 130, 132, 134, 136, 138, 140, 142, any of the panels 130, 132, 134, 136, 138, 140, 142 can be removed and replaced easily with a new panel in case of damage to one or more panels. For example, the first panel 130 can be removed by unscrewing the fasteners 200 and disengaging the first panel 130 from the first strut 170 and the sixth strut 180, and a new panel similar to the first panel 130 can be attached to the first strut 170 and the sixth strut 180. Preferably, the fasteners 200 include a threaded bolt 202 and a threaded nut 204, and the threaded nut 204 is embedded into or otherwise fixedly attached to the first panel 130. In addition, the first strut 179 includes a hole for receiving the threaded bolt 202 and permitting the threaded bolt 202 to extend therethrough so that the threaded bolt 202 can threadingly engage with the respective threaded nut 204 in the first panel 130. Preferably, although not necessarily, the fastener 200 is oriented in this manner so that the threaded bolt 202 extends through the hole in the strut 179 to engage with the threaded nut 204 in the first panel 130, rather than the threaded bolt 202 extending through a hole in the first panel 130 to threadingly engage with a threaded nut 204 fixedly secured to the strut 179. It is understood that the fastener 200 being oriented in this preferable arrangement allows the threaded bolt 202 to be removed from an interior of the article of furniture 100. Therefore, the article of furniture 100 allows replacement of worn out or damaged panels, thereby enabling a cost-effective repair to the article of furniture 100.

In addition, each of the removable panels 130, 132, 134, 136, 138, 140, 142 can be covered with upholstery 196, which can include but is not limited to, cloth, a carpet material, a hard surface material like wood or artificial wood (such as a wood laminate material), and so forth. As shown generally in FIGS. 4-9, the upholstery 196 covers the panel, including any fasteners 200. Each of the removable panels 130, 132, 134, 136, 138, 140, 142 can also optionally include cushioning 198 as part of the upholstery 196, and in particular, the horizontal fifth panel 138 and seventh panel 142 preferably have upholstered cushioning 198. When any of the removable panels 130, 132, 134, 136, 138, 140, 142 are covered by a hard surface material, then the hard surface material is preferably adhered or secured over the surface of the respective panel such that the hard surface is continuous and free of any visible holes, brackets, or other hardware. This can be accomplished by securing the hard surface material to the panel using an adhesive, a mechanical fastener that does not extend entirely through the hard surface material, etc.

Although not shown in the drawings, a bottom edge of the first panel 130, the second panel 132, the third panel 134, and the fourth panel 136, which is located adjacent the floor surface, can include an edgeband (not shown) to give additional strength and protection to the bottom edge. The edgeband can be formed from any suitable type of material, such as metal or a plastic material like PVC.

Figure 4:
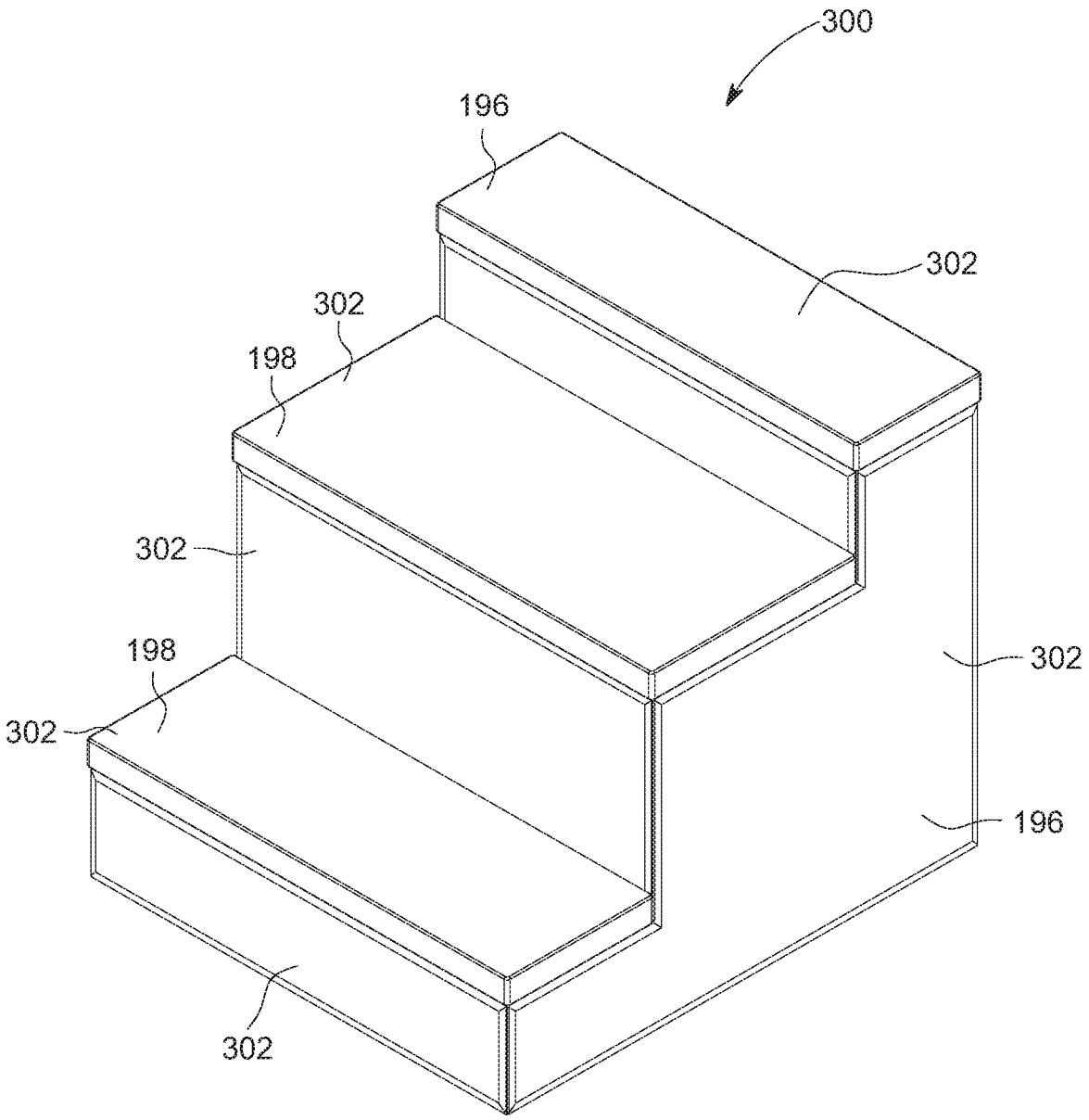
FIG. 4 illustrates a top perspective view of an article of furniture, in accordance with an alternative embodiment of the disclosure.
Figure 5:
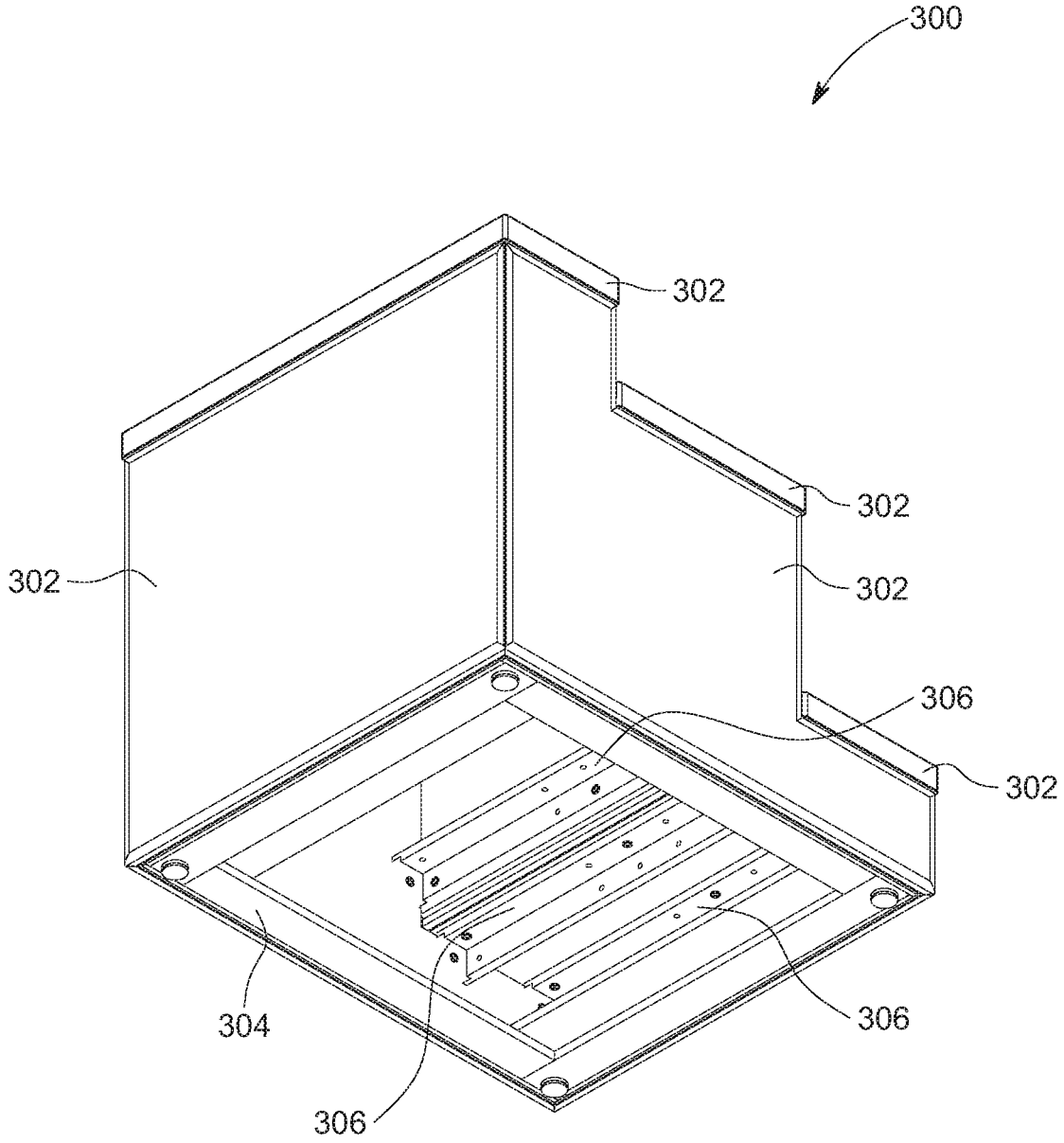
FIG. 5 illustrates a bottom perspective view of the article of furniture of FIG. 4, in accordance with an embodiment of the disclosure.

Referring to FIGS. 4 and 5, an article of furniture 300 is shown according to an alternative embodiment of the disclosure. The article of furniture 300 includes a base 304, a plurality of panels 302, and a plurality of struts 306 that are assembled in a manner similar to an assembly of various components of the article of the furniture 100. Also, the shape of one or more panels, the number of panels, and the number of struts used for assembling the article of furniture 300 may vary. As illustrated, the article of furniture 300 provides three seating surfaces, whereas the article of furniture 100 provides two seating surfaces.

Figure 6:
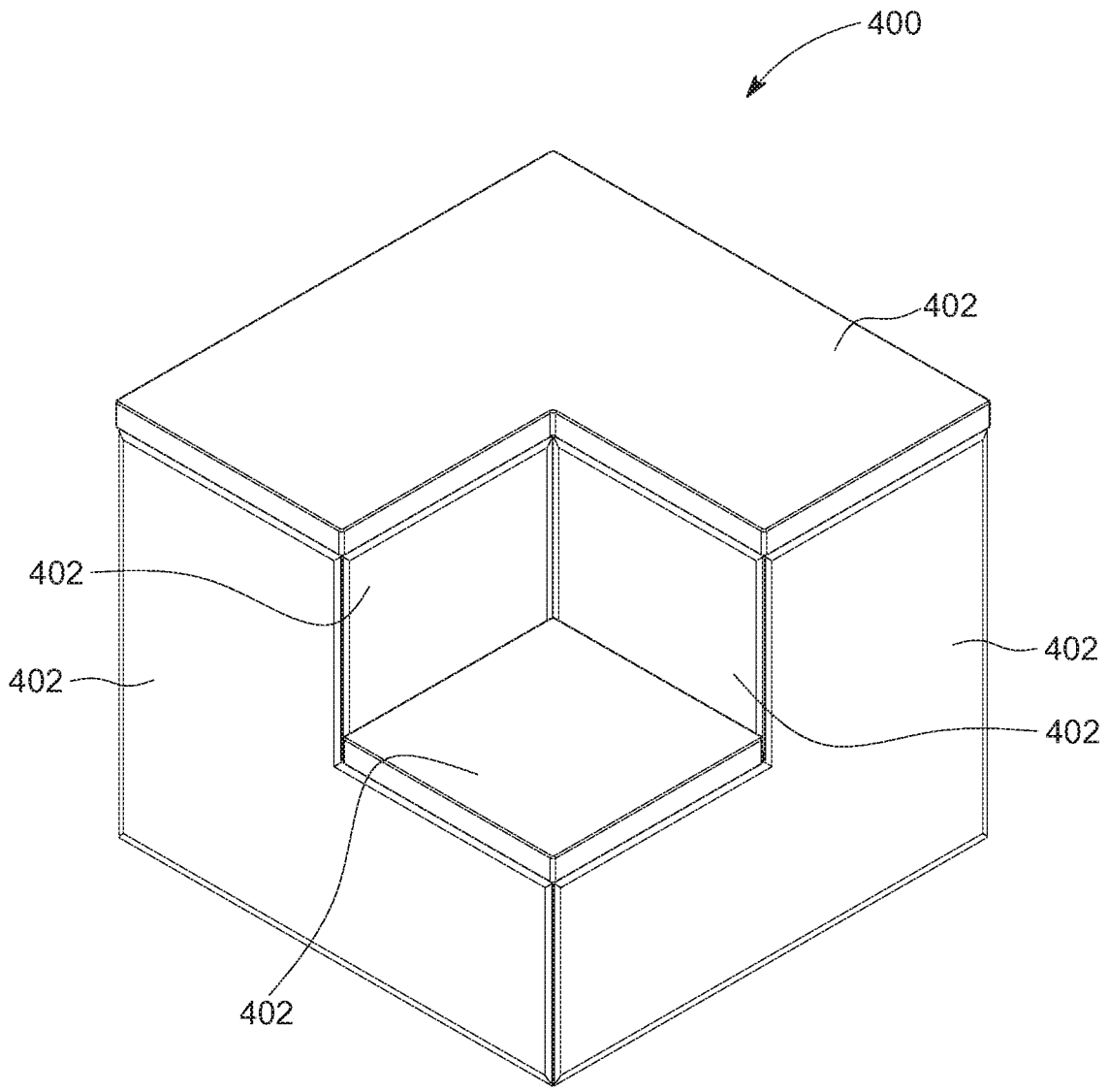
FIG. 6 illustrates a top perspective view of an article of furniture, in accordance with an alternative embodiment of the disclosure.
Figure 7:
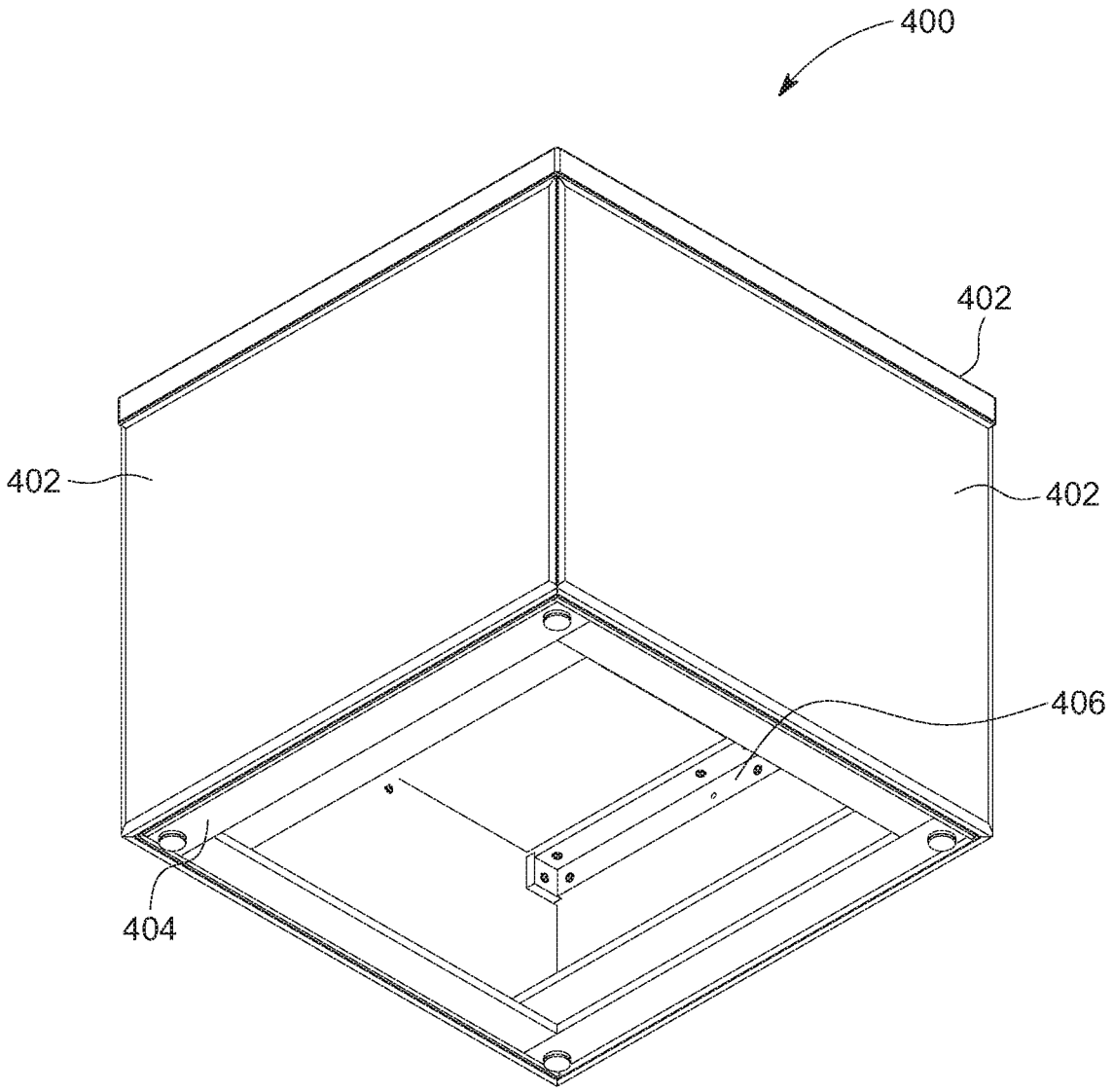
FIG. 7 illustrates a bottom perspective view of the article of furniture of FIG. 6, in accordance with an embodiment of the disclosure.

Referring to FIGS. 6 and 7, an article of furniture 400 is shown according to an alternative embodiment of the disclosure. The article of furniture 400 includes a base 404, a plurality of panels 402, and a plurality of struts 406 that are assembled in a manner similar to an assembly of various components of the article of the furniture 100. Also, the shape of one or more panels, the number of panels, and the number of struts used for assembling the article of furniture 400 may vary.

Figure 8:
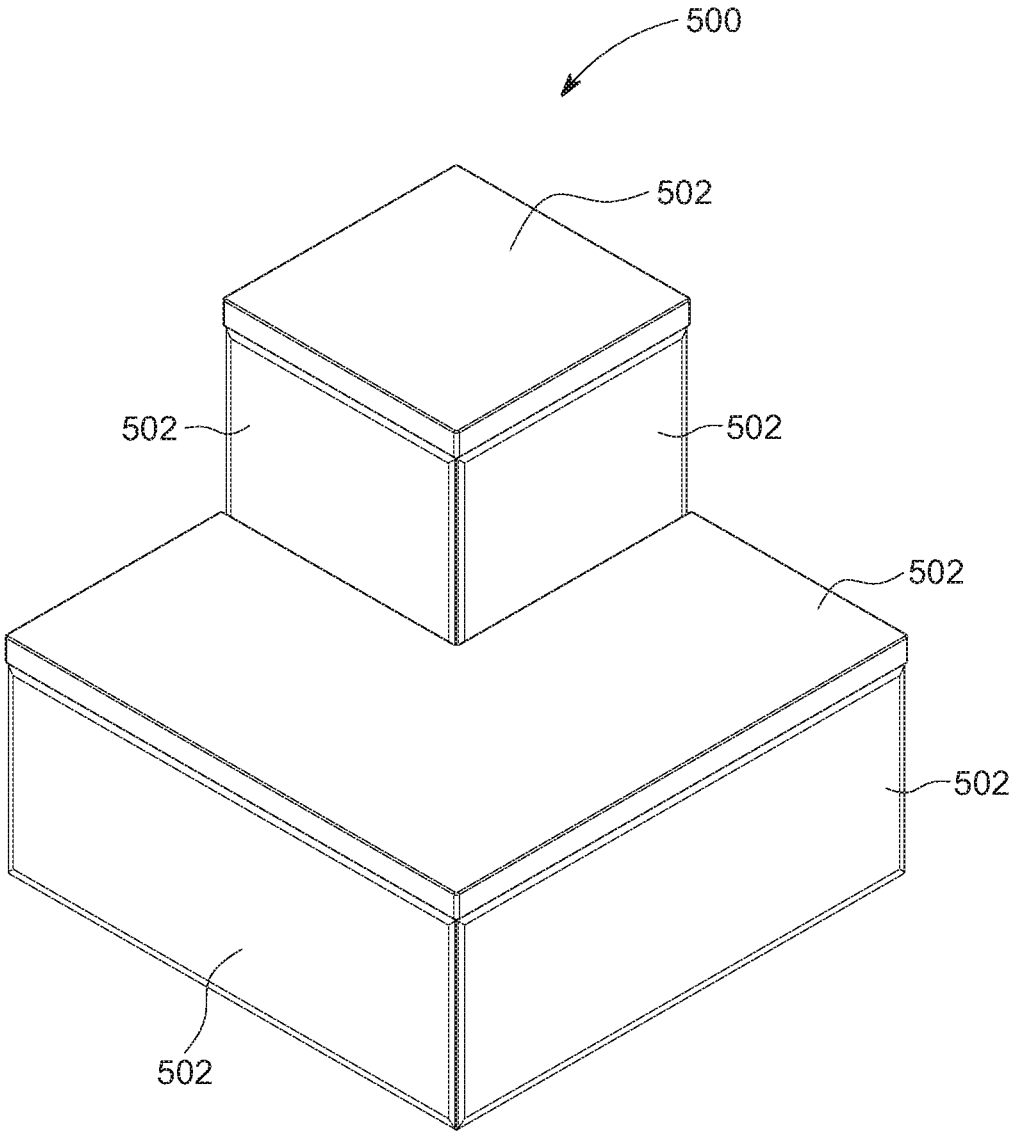
FIG. 8 illustrates a top perspective view of an article of furniture, in accordance with an alternative embodiment of the disclosure.
Figure 9:
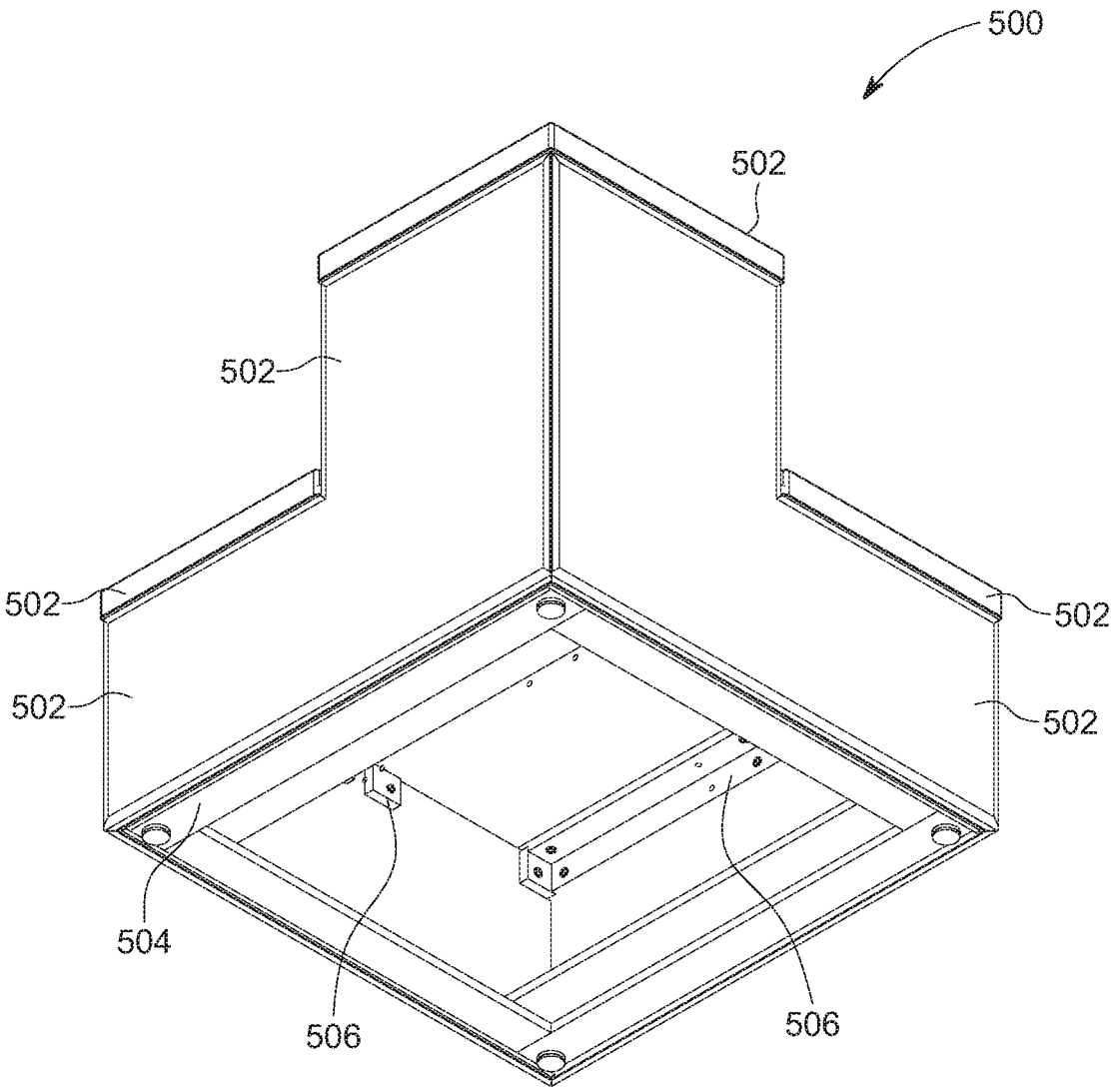
FIG. 9 illustrates a bottom perspective view of the article of furniture of FIG. 8, in accordance with an embodiment of the disclosure.

Referring to FIGS. 8 and 9, an article of furniture 500 is shown according to an alternative embodiment of the disclosure. The article of furniture 500 includes a base 504, a plurality of panels 502, and a plurality of struts 506 that are assembled in a manner similar to an assembly of various components of the article of the furniture 100. Also, the shape of one or more panels, the number of panels, and the number of struts used for assembling the article of furniture 500 may vary.

Furthermore, the articles of furniture 100, 300, 400, and 500 can be provided and positioned adjacent one another as desired by a user to assembly a large modular seating area.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A modular seating system including a plurality of adjacent articles of furniture, the articles of furniture comprising:

a bottom frame, a plurality of panels forming an outer surface of the article of furniture and defining an interior of the article of furniture, and a plurality of struts for securing the panels in place, the struts including a first longitudinal member, a second longitudinal member, and a third member, the first longitudinal member being oriented non-planar to the second longitudinal member whereby the strut has an "L"-shaped cross section, and the third member is disposed at an end of the first longitudinal member and the second longitudinal member, the third member further being connected perpendicularly to both the first longitudinal member and the second longitudinal member whereby each of the first longitudinal member, the second longitudinal member, and the third member are orthogonal to one another;

the bottom frame having an outer periphery which is securable to at least some of the panels, the bottom frame being configured for placement on a floor surface, and the bottom frame having an opening for accessing the interior of the article of furniture;

the struts being configured for securement to at least three adjacent panels which are oriented orthogonal with one another; and wherein the adjacent panels are secured to the respective struts with removable fasteners, the fasteners including a threaded bolt and a threaded nut, whereby the threaded nut is fixedly secured to the panel, and the first longitudinal member, the second longitudinal member, and the third member each include at least one hole, and the respective threaded bolt extends through the respective hole and is threadingly engaged with the respective threaded nut secured to the respective panel.

2. The modular seating system of claim 1 wherein the bottom frame is rectangular in shape.

3. The modular seating system of claim 1 wherein the panels are covered with an upholstery.

4. The modular seating system of claim 3 wherein the upholstery of at least one of the panels includes a cushioning.

5. The modular seating system of claim 3 wherein the fasteners are disposed behind the upholstery.

6. The modular seating system of claim 3 wherein each of the panels are oriented along a substantially vertical plane or a substantially horizontal plane.

7. The modular seating system of claim 1 wherein a first one of the panels is oriented in a first substantially horizontal plane, and a second one of the panels is oriented in a second substantially horizontal plane, the first substantially horizontal plane being distanced from the second substantially horizontal plane.

8. The modular seating system of claim 7 wherein the first one of the panels and the second one of the panels are covered with an upholstery and a cushioning.

9. The modular seating system of claim 1 wherein at least two of the articles of furniture are shaped differently from one another.

* * * * *